US010804652B2

(12) United States Patent
Muro

(10) Patent No.: US 10,804,652 B2
(45) Date of Patent: Oct. 13, 2020

(54) ELECTRICAL CONNECTOR

(71) Applicant: DAI-ICHI SEIKO CO., LTD., Kyoto-shi, Kyoto (JP)

(72) Inventor: Masataka Muro, Ogori (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 16/426,893

(22) Filed: May 30, 2019

(65) Prior Publication Data

US 2020/0006899 A1 Jan. 2, 2020

(30) Foreign Application Priority Data

Jun. 28, 2018 (JP) ..... 2018-123301

(51) Int. Cl.
*H01R 13/6581* (2011.01)
*H01R 13/627* (2006.01)
*H01R 13/405* (2006.01)

(52) U.S. Cl.
CPC ..... *H01R 13/6581* (2013.01); *H01R 13/405* (2013.01); *H01R 13/6273* (2013.01)

(58) Field of Classification Search
CPC .... H01R 12/79; H01R 12/774; H01R 12/775; H01R 12/88; H01R 12/87; H01R 12/772;
(Continued)

(56) References Cited

U.S. PATENT DOCUMENTS 7,094,092 B2 * 8/2006 Yang ..... H01R 12/79 439/495
7,354,300 B2 * 4/2008 Shindo ..... H01R 13/648 439/497

(Continued)

FOREIGN PATENT DOCUMENTS

CN 1301060 A 6/2001
CN 201303082 Y 9/2009

(Continued)

OTHER PUBLICATIONS

Notification of First Office Action (CN Application No. or Patent No. 2019105621754); dated Jul. 16, 2020; 15 pages; Includes English Translation.

*Primary Examiner* — Edwin A. Leon
*Assistant Examiner* — Matthew T Dzierzynski
(74) *Attorney, Agent, or Firm* — Howard & Howard Attorneys PLLC

(57) ABSTRACT

Plural contacts include other ends on which first substrate connections that are connected to the signal electrodes of a substrate are formed. A shell includes an upper plate that covers the whole of the plural contacts on the substrate. Side plates block both ends of the first substrate connections in an array direction (x-axis direction) between the upper plate and the substrate and include edges which face the substrate and on which second substrate connections connected to the ground electrode of the substrate are formed. A back plate blocks the fronts of the first substrate connections with respect to contactors between the upper plate and the substrate and includes an edge which faces the substrate and on which third substrate connections connected to the ground electrode of the substrate are formed.

5 Claims, 7 Drawing Sheets

(58) Field of Classification Search
CPC ..... H01R 13/6275; H01R 13/633; H01R 13/639; H01R 13/6594; H01R 12/721; H01R 13/6582; H01R 12/7029; H01R 12/7076
See application file for complete search history.

(56) References Cited

U.S. PATENT DOCUMENTS

| | | | | |
|---|---|---|---|---|
| 7,934,957 | B1 | 5/2011 | Nakajima et al. | |
| 8,002,567 | B2 * | 8/2011 | Hara | H01R 12/89 439/329 |
| 8,192,219 | B2 * | 6/2012 | Satoh | H01R 12/79 439/328 |
| 8,235,739 | B2 * | 8/2012 | Hashimoto | H01R 12/79 439/328 |
| 8,376,762 | B2 * | 2/2013 | Ozeki | H01R 12/79 439/153 |
| 8,398,417 | B2 * | 3/2013 | Ozeki | H01R 12/774 439/260 |
| 8,512,058 | B2 * | 8/2013 | Ozeki | H01R 12/772 439/260 |
| 8,608,509 | B2 * | 12/2013 | Shimada | H01R 12/774 439/607.01 |
| 8,727,803 | B2 * | 5/2014 | Kurachi | H01R 12/88 439/497 |
| 8,808,020 | B2 * | 8/2014 | Ikari | H01R 12/7029 439/153 |
| 8,814,588 | B2 * | 8/2014 | Wang | H01R 12/774 439/358 |
| 8,851,918 | B2 * | 10/2014 | Yoshisuji | H01R 13/639 439/260 |
| 8,920,183 | B2 * | 12/2014 | Shimada | H01R 12/88 439/260 |
| 8,936,479 | B2 * | 1/2015 | Yokoo | H01R 12/88 439/260 |
| 8,968,020 | B2 * | 3/2015 | Nishiyama | H01R 13/6275 439/345 |
| 9,054,451 | B2 * | 6/2015 | Tateishi | H01R 12/774 |
| 9,263,812 | B2 * | 2/2016 | Ishimaru | H01R 12/7029 |
| 9,397,421 | B2 * | 7/2016 | Ozeki | H01R 12/88 |
| 9,553,410 | B2 * | 1/2017 | Zhao | H01R 12/724 |
| 9,768,534 | B2 * | 9/2017 | Kurachi | H01R 13/6593 |
| 9,847,590 | B2 * | 12/2017 | Kim | H01R 12/79 |
| 9,917,405 | B2 * | 3/2018 | Ju | H01R 13/6583 |
| 9,935,401 | B2 * | 4/2018 | Tsai | H01R 13/652 |
| 9,979,134 | B2 * | 5/2018 | Yu | H01R 13/6585 |
| 10,164,364 | B2 * | 12/2018 | Asanuma | H01R 12/774 |
| 10,177,504 | B2 * | 1/2019 | Zhao | H01R 13/6594 |
| 10,205,259 | B2 * | 2/2019 | Wang | H01R 12/79 |
| 10,270,211 | B2 * | 4/2019 | Yu | H01R 13/6581 |
| 10,305,209 | B2 * | 5/2019 | Ishishita | H01R 12/774 |
| 10,333,254 | B2 * | 6/2019 | Zhao | H01R 13/6585 |
| 10,530,082 | B2 * | 1/2020 | Motoyama | H01R 12/774 |
| 2002/0132518 | A1 | 9/2002 | Kobayashi | |
| 2004/0248447 | A1 * | 12/2004 | Aoki | H01R 12/771 439/260 |
| 2007/0066142 | A1 | 3/2007 | Shindo | |
| 2009/0035956 | A1 | 2/2009 | Okamura | |
| 2012/0196466 | A1 * | 8/2012 | Igarashi | H01R 12/775 439/329 |
| 2014/0342592 | A1 | 11/2014 | Ashibu et al. | |
| 2015/0171536 | A1 * | 6/2015 | Kameda | H01R 12/772 439/329 |
| 2016/0087378 | A1 * | 3/2016 | Chen | H01R 13/6597 439/607.34 |
| 2018/0198246 | A1 * | 7/2018 | Cheng | H01R 12/727 |

FOREIGN PATENT DOCUMENTS

| | | | |
|---|---|---|---|
| CN | 102142648 | A | 8/2011 |
| CN | 104167642 | A | 11/2014 |
| EP | 0762324 | A2 | 3/1997 |
| JP | 2005322470 | A | 11/2005 |
| JP | 2015222638 | A | 12/2015 |

* cited by examiner

ELECTRICAL CONNECTOR

CROSS-REFERENCE TO RELATED APPLICATION

This application claims priority to Japanese Patent Application No. 2018-123301, filed on Jun. 28, 2018, the entire disclosure of which is incorporated by reference herein.

FIELD

This application relates generally to an electrical connector.

BACKGROUND

Unexamined Japanese Patent Application Kokai Publication No. 2005-322470 discloses an electrical connector in which a shell for a ground is formed to cover the top surface, under surface, and both sides of a housing. According to the electrical connector, a cable in the housing can be electrically shielded in any direction of the top surface, under surface, and both sides of the housing, and therefore, the effect of preventing electromagnetic wave interference can be improved.

SUMMARY

In the electrical connector disclosed in Patent Literature 1, however, a substrate connection connected to a substrate at a terminal via which the cable and the substrate are connected to each other is exposed to the outside. This substrate connection is a part of a signal transmission line which transmits a signal. Accordingly, noise may leak from the substrate connection to the outside or may be contaminated from the outside into a signal line.

An objective of the present disclosure is to provide an electrical connector that can more reliably prevent noise from leaking from a substrate connection to the outside and noise from being contaminated from the outside into the substrate connection.

In order to achieve the objective described above, an electrical connector according to the present disclosure includes:

a plurality of conductive contacts that is arrayed in one direction in correspondence with a plurality of respective signal transmission members of a connection object, that includes one ends on which contactors that come into contact with the signal transmission members are formed, and that includes other ends on which first substrate connections that are connected to signal electrodes of a substrate are formed;

an insulating housing that retains the contacts; and a conductive shell that is connected to a ground electrode of the substrate and that comes into contact with a ground member of the connection object, wherein the shell includes:

an upper plate that covers a whole of the plurality of contacts on the substrate;

side plates that block both ends of the first substrate connections in an array direction between the upper plate and the substrate and that include edges that face the substrate and on which second substrate connections connected to the ground electrode of the substrate are formed; and a back plate that blocks fronts of the first substrate connections with respect to the contactors between the upper plate and the substrate and that includes an edge that faces the substrate and on which a third substrate connection connected to the ground electrode of the substrate is formed.

In such a case, the plurality of third substrate connections may be arrayed at an equal spacing along the array direction of the first substrate connections.

The back plate may be coupled to the upper plate, and a plurality of through-holes may be disposed at an equal spacing along the array direction of the first substrate connections in a coupling portion between the back plate and the upper plate.

An insertion opening into which the connection object may be inserted is disposed in the housing, and the shell may include:

a first shell that includes the upper plate, the side plates, and the back plate, that comes into contact with the ground member of the connection object in the insertion opening, and that is connected to the ground electrode of the substrate; and a second shell that is inserted between the substrate and a portion other than the first substrate connections in the plurality of contacts, that comes into contact with the ground member of the connection object in the insertion opening, and that is connected to the ground electrode of the substrate.

Locking members in a pair that are disposed on both ends of the plurality of contacts in an array direction, respectively, and that are locked on the connection object inserted into the insertion opening may be included, and the first shell, the second shell, and the locking member may include an identical, plate-like member.

The respective locking members in the pair may be arranged to overlap the side plates at both the ends of the contacts in the array direction.

According to the present disclosure, a state can be achieved in which a first substrate connection connected to the signal electrodes of a substrate in a contact is surrounded by an upper plate, side plates, and a back plate which are components included in a conductive shell connected to the ground electrode of the substrate. As a result, a current component caused by noise trapped by the upper plate, the side plates, and the back plate can be immediately passed through the ground electrode. Therefore, the noise can be more reliably prevented from leaking from the first substrate connection to the outside, and the noise can be more reliably prevented from being contaminated from the outside into the first substrate connection.

BRIEF DESCRIPTION OF THE DRAWINGS

A more complete understanding of this application can be obtained when the following detailed description is considered in conjunction with the following drawings, in which.

DETAILED DESCRIPTION

Figure 1A:
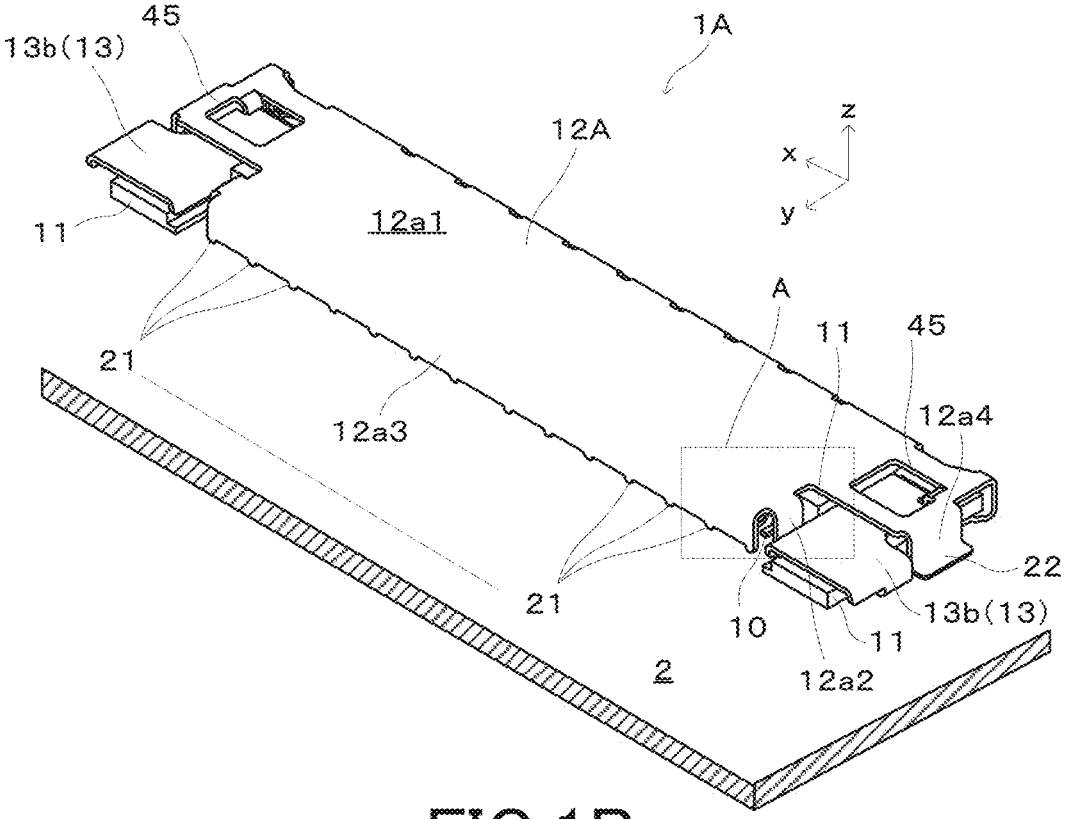
FIG. 1A is a perspective view illustrating the appearance of an electrical connector according to Embodiment 1 of the present disclosure.

Embodiments of the present disclosure will be described in detail below with reference to the drawings. In all the drawings, the same or equivalent components are denoted by the same reference characters.

Embodiment 1

Figure 1B:
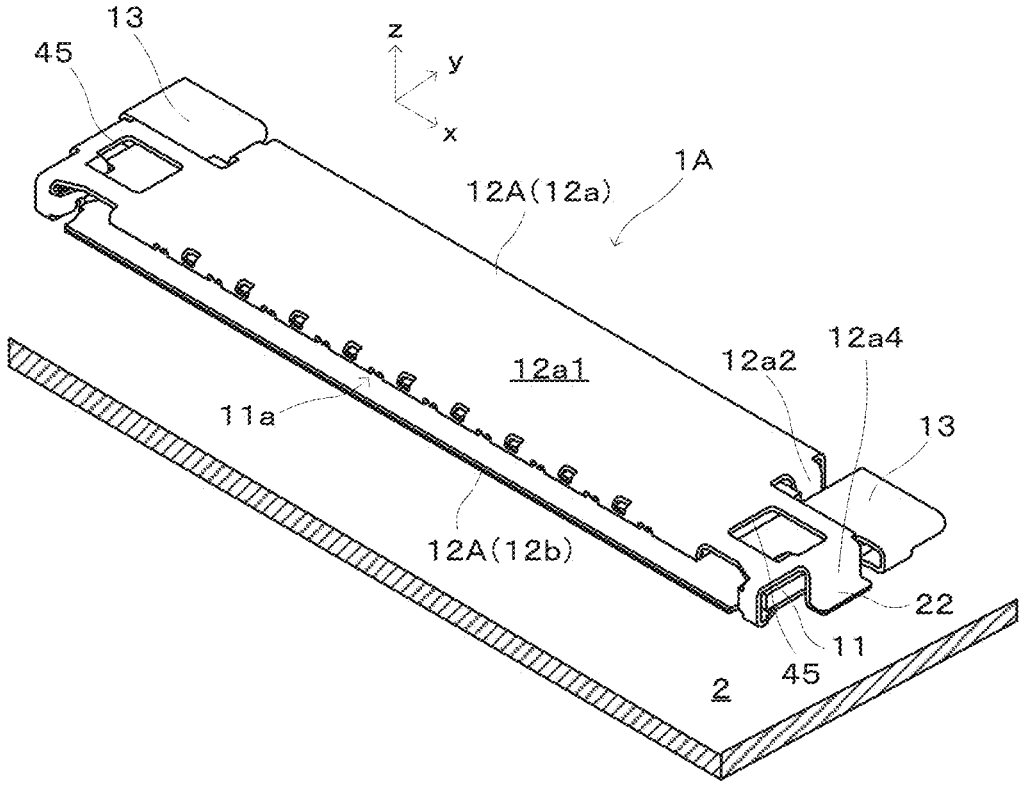
FIG. 1B is a perspective view illustrating the appearance of the electrical connector according to Embodiment 1 of the present disclosure from a different orientation.
Figure 2A:
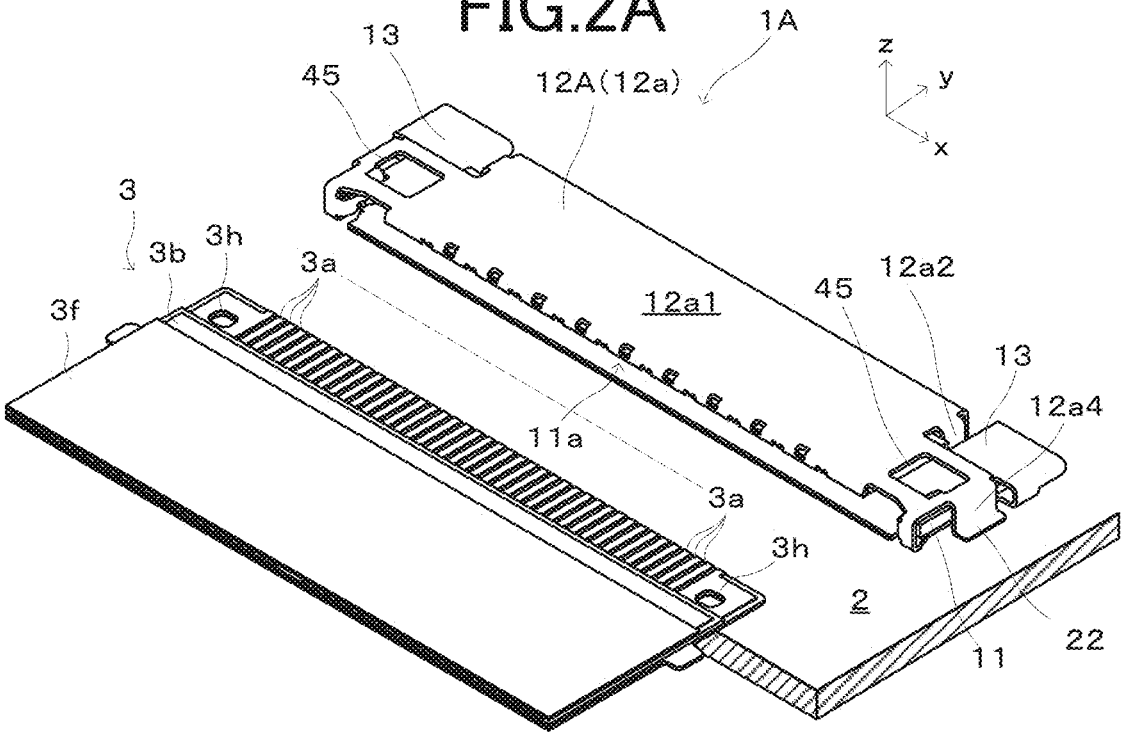
FIG. 2A is a perspective view illustrating the appearance of the electrical connector into which a signal transmission medium has not yet been inserted.
Figure 2B:
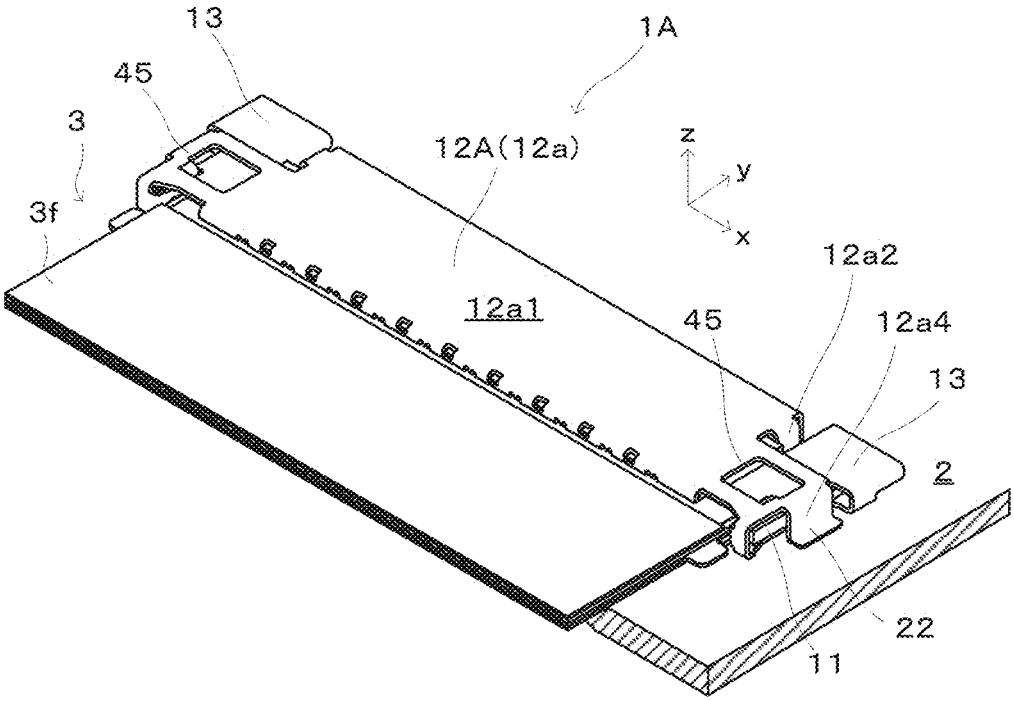
FIG. 2B is a perspective view illustrating the appearance of the electrical connector in a state in which the signal transmission medium is inserted into the electrical connector.

First, Embodiment 1 of the present disclosure will be described. An electrical connector 1A according to the present embodiment is mounted on a substrate 2 as illustrated in FIGS. 1A and 1B, and a signal transmission medium 3 as a connection object is inserted into the electrical connector 1A as illustrated in FIGS. 2A and 2B.

The signal transmission medium 3 is a flat-plate-shaped medium that transmits a signal, such as a flexible flat cable (FFC) or a flexible printed circuit board (FPC). The electrical connector 1A electrically connects the substrate 2 and the signal transmission medium 3 to each other. Specifically, the electrical connector 1A electrically connects the signal electrodes 2*a* of the substrate 2 and the signal lines (signal transmission members) 3*a* of the signal transmission medium 3 to each other (see FIG. 5B), and electrically connects the ground electrode 2*b* of substrate 2 and the ground transmission paths 3*b* and 3*c* of the signal transmission medium 3 to each other (see FIG. 5C).

The electrical connector 1A forms signal transmission lines that transmit a signal, together with the substrate 2 and the signal transmission medium 3. The electrical connector 1A prevents noise from leaking from the signal transmission lines to the outside and prevents noise from being contaminated from the outside into the signal transmission lines.

The electrical connector 1A includes: contacts 10 which are parts of the signal transmission lines; a housing 11 which is a case for the electrical connector 1A; and a shell 12A which is a noise shielding member.

Figure 3A:
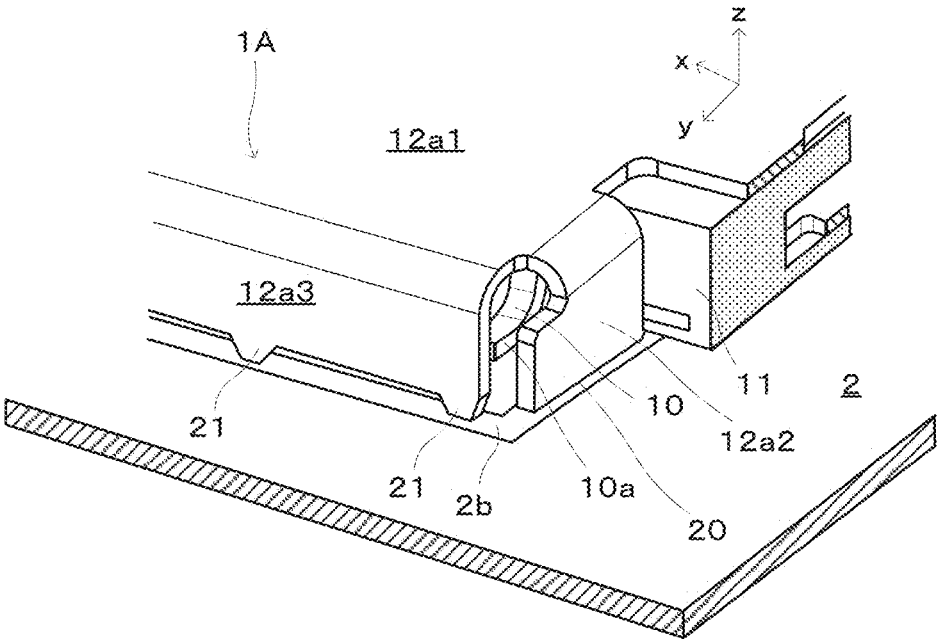
FIG. 3A is an enlarged view of an area A of FIG. 1A.
Figure 5A:
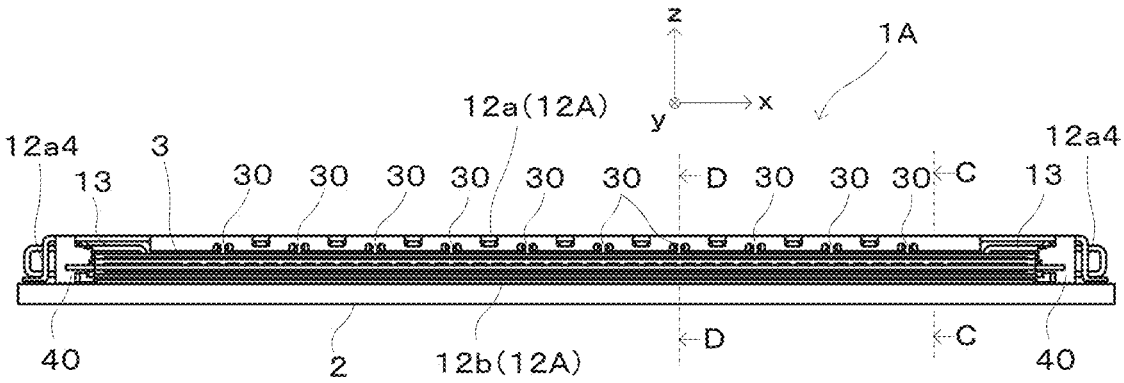
FIG. 5A is a front view of the electrical connector according to Embodiment 1 of the present disclosure.
Figure 5B:
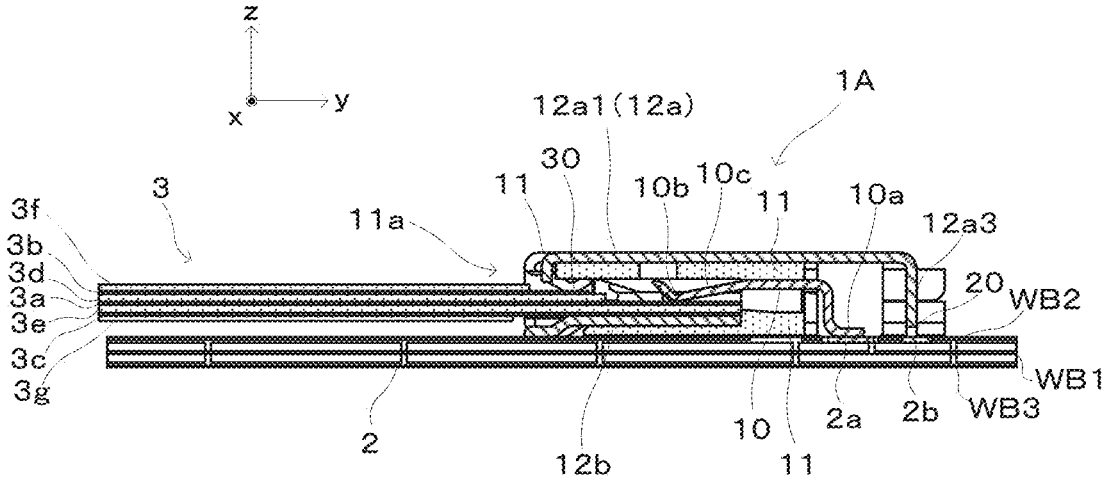
FIG. 5B is a cross-sectional view taken along a line C-C of FIG. 5A.

The contacts 10 are long, thin, and conductive members that include, for example, a bent and formed metal and that extend in the y-axis direction (see FIG. 5B). The contacts 10 are arranged in a space surrounded by the shell 12A. The contacts 10 can be confirmed from the outside through only the small gaps of shell 12A, as illustrated in FIGS. 1A, 1B, and 3A.

Figure 3B:
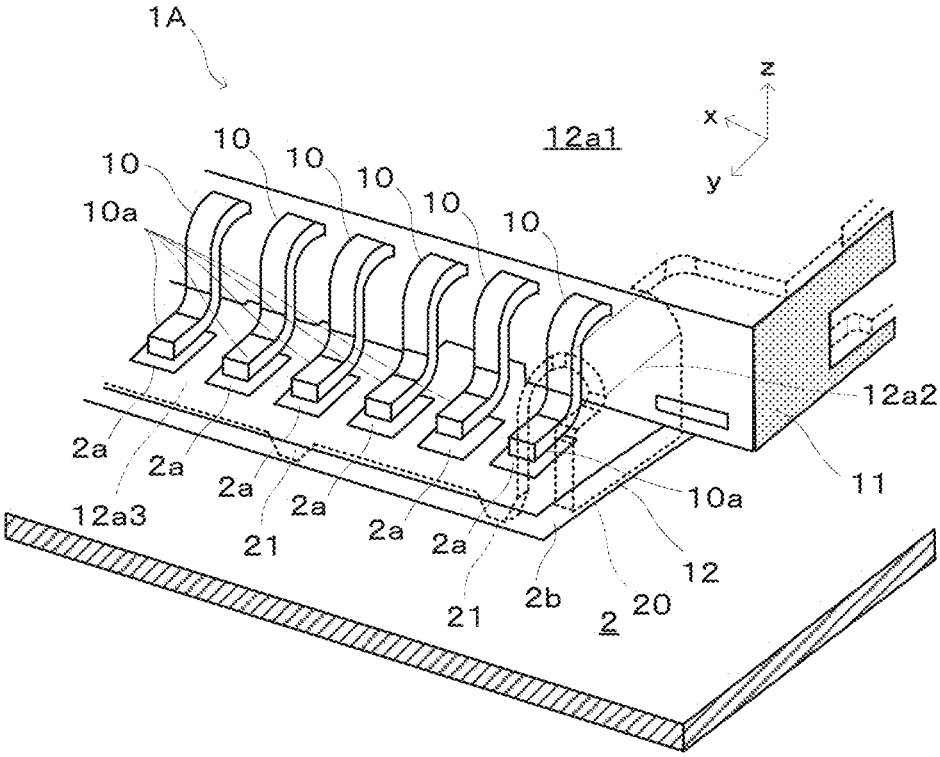
FIG. 3B is a view of a state in which a shell is removed from FIG. 3A.

As illustrated in FIG. 3B, first substrate connections 10*a* are disposed on one ends (+y end) of the contacts 10. The first substrate connections 10*a* are electrically connected to the signal electrodes 2*a* of the substrate 2 by soldering. The contacts 10 are connected to the signal electrodes 2*a* of the substrate 2 at the first substrate connections 10*a*, and are connected to the signal lines 3*a* of the signal transmission medium 3 which is the connection object, at contactors 10*b* disposed on the other ends (−y ends) (see FIG. 5B).

As illustrated in FIG. 3B, the plural signal electrodes 2*a* are arrayed on the substrate 2 at the same pitch in a single line in the x-axis direction. In the signal transmission medium 3, the plural signal lines 3*a* extending in the y-axis direction are arrayed at the same pitch in a single line in the x-axis direction, as illustrated in FIG. 2A. The array pitch of the signal electrodes 2*a* of the substrate 2 and the array pitch of the signal lines 3*a* of the signal transmission medium 3 are the same as each other.

In the electrical connector 1A, the plural contacts 10 are arrayed at the same pitch in one direction (x-axis direction) in correspondence with the plural respective signal electrodes 2*a* and the plural respective signal lines 3*a*, as illustrated in FIG. 3B, in order to achieve one-to-one electrical connection between the plural signal electrodes 2*a* and the plural signal lines 3*a*. The array pitch of the contacts 10 is the same as the array pitches of the signal electrodes 2*a* and the signal lines 3*a*. The contactors 10*b* of the contacts 10 come into contact with ends of the signal lines 3*a* exposed to the outside at an end of the signal transmission medium 3 (see FIG. 5B).

The housing 11 is an insulating member molded with, for example, a resin. The housing 11 retains the contacts 10. Specifically, the contacts 10 are press-fit into the housing 11 or are retained by the housing 11 in the state of being integrally molded with the housing 11. The first substrate connections 10*a* and the contactors 10*b*, in the state of being retained by the housing 11, project from the housing 11 in directions opposite to each other (+y direction and −y direction) (see FIG. 5B). Further, a portion including the contactors 10*b* projecting from the housing 11 is a cantilever (movable beam 10*c*) which can be displaced in the z-axis direction.

An insertion opening 11*a* into which the signal transmission medium 3 is inserted is disposed in the housing 11. The insertion opening 11*a* is a slit-shaped opening of which the longitudinal direction is the array direction (x-axis direction) of the contacts 10. In the insertion opening 11*a*, the contactors 10*b* of the contacts 10 project in a mountain shape (see FIG. 5B).

When the signal transmission medium 3 is normally inserted into the deep recess of the insertion opening 11*a*, the x-positions of the contacts 10 and the x-positions of the signal lines 3*a* coincide with each other, and the elastic force of the movable beam 10*c* of the contacts 10 causes the signal lines 3*a* of the signal transmission medium 3 and the contactors 10*b* of the contact 10 to come into contact with each other.

The shell 12A is a conductive member including, for example, a metal. The shell 12A is a noise shielding member that covers the whole of the contacts 10 and the housing 11, as illustrated in FIGS. 1A and 1B.

Figure 5C:
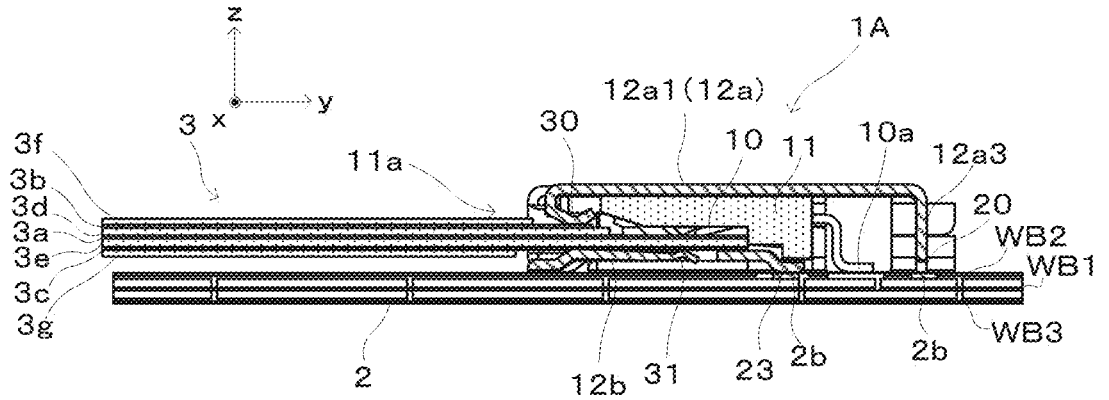
FIG. 5C is a cross-sectional view taken along a line D-D of FIG. 5A.

As illustrated in FIG. 3B, the shell 12A is connected to the ground electrode 2*b* of the substrate 2 and comes into contact with the ground transmission path 3*b* as the ground member of the signal transmission medium 3 (see FIG. 5C). An electromagnetic wave (noise) trapped by the shell 12A becomes a current component, which flows out through the ground electrode 2*b*, the ground transmission path 3*b*, or the like. As a result, the shell 12A functions as a noise shielding member.

Figure 4A:
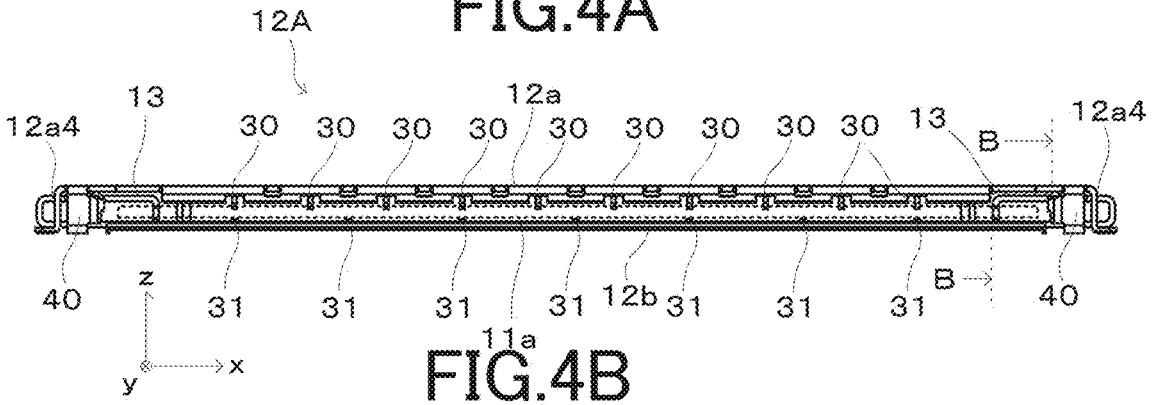
FIG. 4A is a front view of an electrical connector according to Embodiment 1 of the present disclosure.

As illustrated in FIG. 4A, an upper shell 12*a* as a first shell and a lower shell 12*b* as a second shell are disposed in the shell 12A. The upper shell 12*a* and the lower shell 12*b* are coupled to each other via a coupler 40, as described later. The shell 12A is a frame-shaped member of which the center is the insertion opening 11*a*, as viewed from the −y direction.

The upper shell 12*a* is disposed on the +z side of the insertion opening 11*a* of the housing 11, as illustrated in FIG. 4A. The upper shell 12*a* serves as the top plate of the noise shielding member. The upper shell 12*a* comes into contact with the ground transmission path 3*b* of the signal transmission medium 3 arranged in the +z side of the signal lines 3*a* in the insertion opening 11*a* (see FIG. 5C).

In the upper shell 12*a*, the second substrate connections 20 and the third substrate connections 21 are disposed on a portion coming into contact with the substrate 2, as illustrated in FIG. 3B. The second substrate connections 20 and the third substrate connections 21 are connected to the ground electrode 2*b* of the substrate 2.

The upper shell 12*a* further includes an upper plate 12*a*1, side plates 12*a*2, a back plate 12*a*3, and side plates 12*a*4.

The upper plate 12*a*1 covers the whole of the plural contacts 10 on the substrate 2. Shell springs 30 are disposed on the upper plate 12*a*1, as illustrated in FIG. 4A. The shell springs 30 are elastic members for the cantilever, which project in a mountain shape and extend in the direction of inserting the signal transmission medium 3, in the insertion opening 11*a*.

As illustrated in FIG. 4A, the plural shell springs 30 are disposed, and arrayed in the x-axis direction. An array spacing between the shell springs 30 is determined based on the frequency of a signal transmitted to the contacts 10. Specifically, the array spacing between the shell springs 30 is not less than 1/20 of the wavelength of the transmitted signal.

Insertion of the signal transmission medium 3 into the insertion opening 11*a* causes the shell springs 30 to abut on the signal transmission medium 3, to be elastically deformed, and to come into press contact with the ground transmission path 3*b* of the signal transmission medium 3.

The side plates 12*a*2 block both ends, between the upper plate 12*a*1 and the substrate 2, in the array direction (x-axis direction) of the first substrate connections 10*a*, as illustrated in FIG. 3A. The second substrate connections 20 are formed on edges, facing the substrate 2, of the side plates 12*a*2. The second substrate connections 20 are electrically connected to the ground electrode 2*b* of the substrate 2 by soldering.

The back plate 12*a*3 is formed by bending the +y end of the upper plate 12*a*1, as illustrated in FIG. 3A. The back plate 12*a*3 blocks the fronts (+y side) of the first substrate connections 10*a* with respect to the contactors 10*b* of the contact 10, between the upper plate 12*a*1 and the substrate 2. The third substrate connections 21 are disposed on the edge, facing the substrate 2, of the back plate 12*a*3. The third substrate connections 21 are electrically connected to the ground electrode 2*b* of the substrate 2 by soldering.

The plural third substrate connections 21 are arrayed at an equal spacing along the array direction (x-axis direction) of the first substrate connections 10*a*. The array spacing of the third substrate connections 21 is not more than the half-wavelength of the fifth harmonic of a signal transmitted through the contacts 10. As a result, noise having a wavelength that is not less than the wavelength of the fifth harmonic of the signal can be prevented from leaking and being contaminated.

The side plates 12*a*4 are disposed on portions, on which the side plates 12*a*2 are not disposed, of both ends of the electrical connector 1A in the x-axis direction, as illustrated in FIG. 1A. Fourth substrate connections 22 are disposed on edges, facing the substrate 2, of the side plates 12*a*4. The fourth substrate connections 22 are electrically connected to the ground electrode 2*b* of the substrate 2 by soldering.

The lower shell 12*b* is disposed on the −z side of the insertion opening 11*a*, as illustrated in FIG. 4A. Specifically, the lower shell 12*b* is inserted between the substrate 2 and the portions, other than the first substrate connections 10*a*, of the plural contacts 10 (see FIG. 5C). The lower shell 12*b* functions as a noise shielding member for the −z side of the signal transmission medium 3.

Shell springs 31 are disposed on the lower shell 12*b*. The shell springs 31 are elastic members for the cantilever, which extend in the direction of inserting the signal transmission medium 3, in the insertion opening 11*a* (see FIG. 5C).

As illustrated in FIG. 4A, the plural shell springs 31 are disposed, and arrayed in the x-axis direction. An array spacing between the shell springs 31 is determined based on the frequency of a signal transmitted through the contacts 10. Specifically, the array spacing between the shell springs 31 is set to prevent generation of a gap that is not less than 1/20 of the wavelength of the transmitted signal.

The shell springs 31 project in a mountain shape in the insertion opening 11*a*, and come into contact with the ground transmission path 3*c* of the signal transmission medium 3, arranged on the −z sides of the signal lines 3*a*, in the insertion opening 11*a* (see FIG. 5C). A fifth substrate connection 23 is disposed on the lower shell 12*b*. The fifth substrate connection 23 is connected to the ground electrode 2*b* of the substrate 2.

Further, lock members (locking members) 13 in a pair are disposed on both ends of the electrical connector 1A in the x-axis direction. The lock members 13 are disposed on both the respective ends in the array direction (x-axis direction) of the plural contacts 10 and locks the signal transmission medium 3 inserted into the insertion opening 11*a*.

Figure 6A:
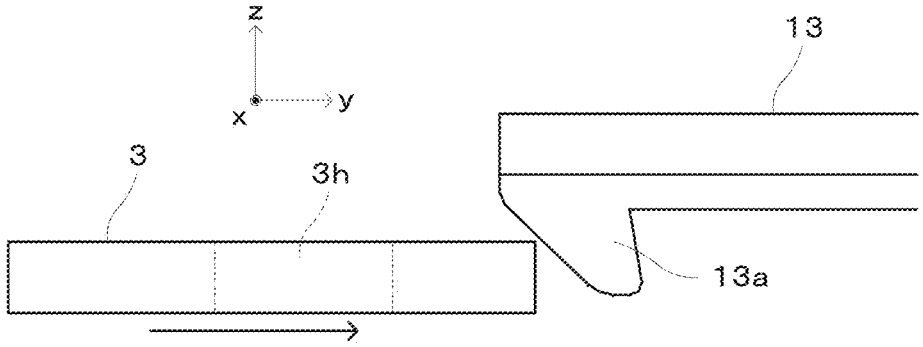
FIG. 6A is a first view illustrating a state in which a lock member is engaged in the positioner of the signal transmission medium.
Figure 6B:
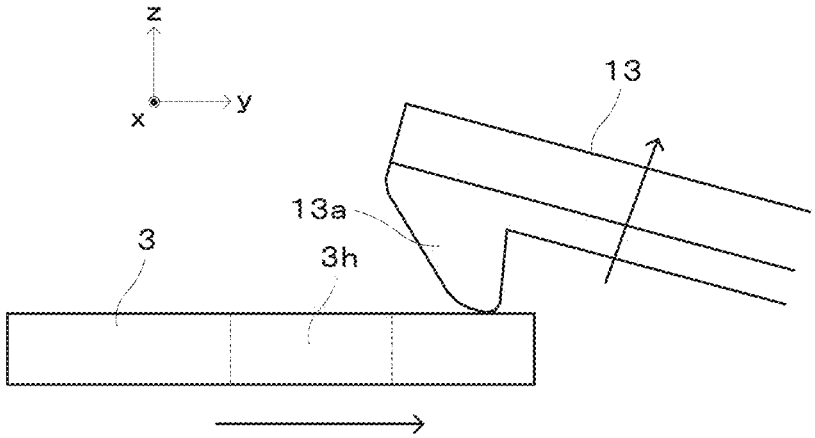
FIG. 6B is a second view illustrating a state in which the lock member is engaged in the positioner of the signal transmission medium.
Figure 6C:
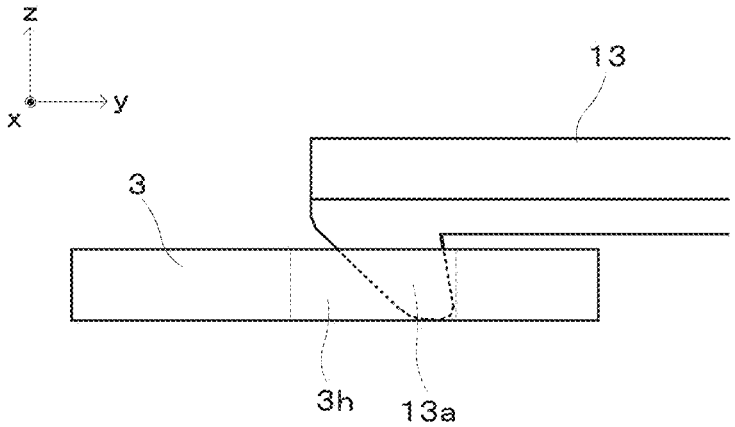
FIG. 6C is a third view illustrating a state in which a lock member is engaged in the positioner of the signal transmission medium.

The lock members 13 are cantilevered members including leading ends provided with locking pawls 13*a*. As illustrated in FIG. 2A, positioners 3*h* which are through-holes are disposed in the signal transmission medium 3. Insertion of the signal transmission medium 3 into the insertion opening 11*a* causes an edge of the signal transmission medium 3 to abut on the locking pawls 13*a* as illustrated in FIG. 6A, and allows the lock members 13 to be pushed up in the +z direction along the slopes of the locking pawls 13*a* as illustrated in FIG. 6B. Insertion of the signal transmission medium 3 into the deep recess of the insertion opening 11*a* causes the locking pawls 13*a* to get into the positioners 3*h* of the signal transmission medium 3 to allow the lock members 13 and the signal transmission medium 3 to be engaged with each other, as illustrated in FIG. 6C.

Operators 13*b* are disposed in the lock members 13. In order to remove the signal transmission medium 3 inserted into the insertion opening 11*a*, the operators 13*b* are operated to cancel the engagement between the locking pawls 13*a* and the positioners 3*h*, and the signal transmission medium 3 is then removed from the insertion opening 11*a*.

Through-holes 45 through which the states of the leading ends of the lock member 13 can be confirmed are disposed in both ends of the upper plate 12*a*1 of the shell 12A in the x-axis direction. Whether or not the signal transmission medium 3 is appropriately inserted can be confirmed through the through-holes 45.

Figure 4B:
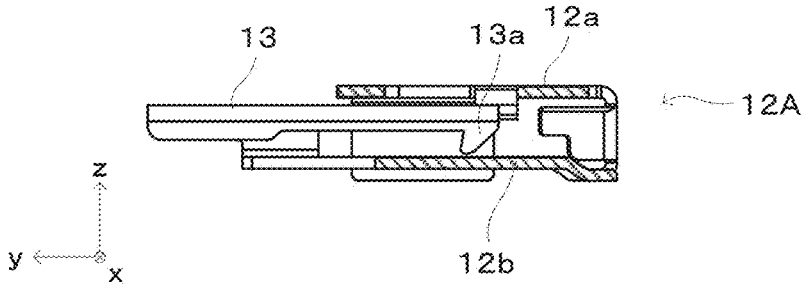
FIG. 4B is a cross-sectional view taken along the line B-B of FIG. 4A.
Figure 4C:
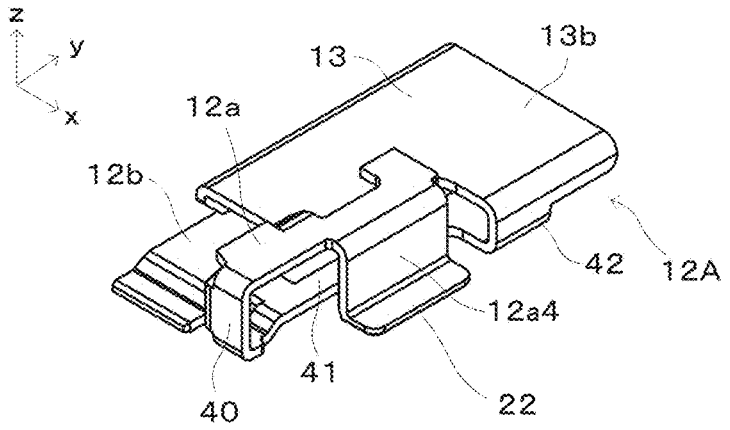
FIG. 4C is a cross-sectional perspective view (1) taken along a line B-B of FIG. 4A.
Figure 4D:
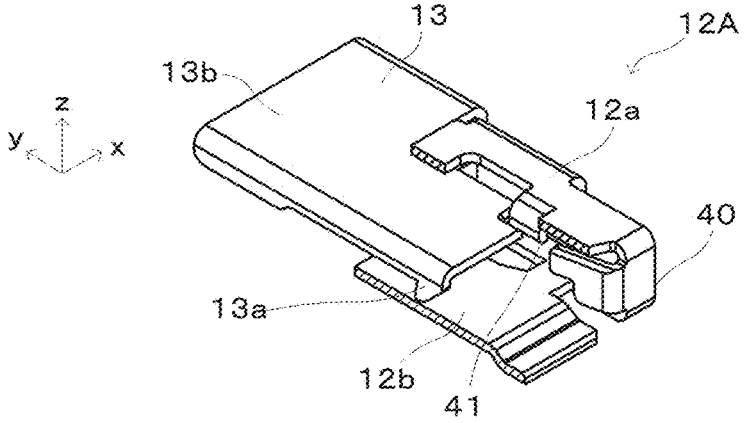
FIG. 4D is a cross-sectional perspective view (2) taken along the line B-B of FIG. 4A.

In the electrical connector 1A, the upper shell 12*a*, the lower shell 12*b*, and the lock members 13 are formed of the same plate-like member. In the shell 12A, the upper shell 12*a* and the lower shell 12*b* are coupled to each other via the coupler 40, as illustrated in FIGS. 4B, 4C, and 4D. In addition, the lower shell 12*b* and the lock members 13 are coupled to each other via couplers 41 and 42. The upper shell 12*a*, the lower shell 12*b*, and the lock members 13 are formed of the same plate-like member, thereby enabling the number of components to be reduced and enabling the production cost of the electrical connector 1A to be reduced.

The lock member 13 is elastically deformed when the signal transmission medium 3 is inserted into the insertion opening 11*a*. However, the lock members 13 and the lower shell 12*b* are coupled to each other via the couplers 41 and 42 which are long, slim, and bent, and therefore, the lock members 13 are designed so that force caused by deformation of the lock members 13 is inhibited from being transmitted to the lower shell 12*b*.

The respective lock members 13 in the pair are arranged on both the ends in the array direction (x-axis direction) of the contacts 10 so as to overlap the side plates 12*a*2. As a result, the leakage of noise from the contacts 10 to the outside and the contamination of noise from the outside into the contacts 10 can be more reliably prevented. The same applies to the side plates 12*a*4.

The action of the electrical connector 1A according to the present embodiment will now be described. A state illustrated in FIGS. 5B and 5C is achieved when the electrical connector 1A is mounted on the substrate 2 as illustrated in FIG. 1B, the signal transmission medium 3 is inserted into the electrical connector 1A as illustrated in FIG. 2B, and the locking pawls 13*a* of the lock members 13 are engaged with the positioners 3*h* of the signal transmission medium 3.

In such a case, the contactors 10*b* of the contacts 10 and the signal lines 3*a* of the signal transmission medium 3 come into contact with each other, as illustrated in FIG. 5B. As a result, the signal transmission lines including the signal electrodes 2*a* of the substrate 2, the contacts 10, and the signal lines 3*a* of the signal transmission medium 3 are formed.

The plural signal transmission lines are disposed in the x-axis direction. In such a case, a single-ended signal may be transmitted through one signal transmission line, or a differential signal may be transmitted using signal transmission lines in a pair. Moreover, in the case of transmitting the differential signal, signal transmission lines in both sides of the signal transmission lines in the pair may be used as ground transmission lines. Such a manner enables a reduction in the leakage, that is, crosstalk of noise from the signal transmission lines in the pair, through which the differential signal is transmitted, to signal transmission lines in a pair through which another differential signal is transmitted.

In such a state, the upper shell 12*a* of the shell 12A further comes into contact with the ground transmission path 3*b* of the signal transmission medium 3 inserted into the insertion opening 11*a*, as illustrated in FIG. 5C. As a result, a transmission line for grounding, including the ground electrode 2*b* of the substrate 2, the upper shell 12*a* of the shell 12A, and the ground transmission path 3*b* of the signal transmission medium 3, is formed.

In such a state, the lower shell 12*b* of the shell 12A further comes into contact with the ground transmission path 3*c* of the signal transmission medium 3 inserted into the insertion opening 11*a*, as illustrated in FIG. 5C. As a result, a transmission line for grounding, including the ground electrode 2*b* of the substrate 2, the lower shell 12*b* of the shell 12A, and the ground transmission path 3*c* of the signal transmission medium 3, is formed.

The transmission lines for a signal, illustrated in FIG. 5B, are sandwiched between the transmission line for grounding, including the upper shell 12*a*, and the transmission line for grounding, including the lower shell 12*b*, illustrated in FIG. 5C. Accordingly, the signal transmission lines are shielded from the outside in the z-axis direction, and the leakage of noise from the signal transmission lines to the outside and the contamination of noise from the outside into the signal transmission lines can be prevented.

In the shell 12A, the +y sides of the contacts 10 is shielded by the back plate 12*a*3. In the −y sides, the shell springs 30 of the upper shell 12*a* come into contact with the ground transmission path 3*b* of the signal transmission medium 3, and the shell springs 31 of the lower shell 12*b* come into contact with the ground transmission path 3*c* of the signal transmission medium 3. Accordingly, the signal transmission lines are shielded from the outside in the y-axis direction, and the leakage of noise from the signal transmission line to the outside and the contamination of noise from the outside into the signal transmission lines can be prevented.

Further, the side plates 12*a*2 and side plates 12*a*4 of the upper shell 12*a*, and the lock members 13 shield both sides of the contacts 10 in the x-axis direction. Accordingly, the signal transmission lines are shielded from the outside in the x-axis direction, and the leakage of noise from the signal transmission lines to the outside and the contamination of noise from the outside into the signal transmission lines can be prevented.

The side plates 12*a*2, the back plate 12*a*3, and the side plates 12*a*4 are directly connected to the ground electrode 2*b* of the substrate 2 through faces, that is, the second substrate connections 20, the third substrate connections 21, and the fourth substrate connections 22, facing the substrate 2. As a result, a path through which a current caused by noise flows can be shortened, and noise can be more reliably shielded by the side plates 12*a*2, the back plate 12*a*3, and the side plates 12*a*4. As a result, the electrical connector 1A enables transmission of a signal having a low noise component between the substrate 2 and the signal transmission medium 3.

The third substrate connections 21 are arrayed at an equal spacing in the x-axis direction. However, since the spacing is shorter than the half-wavelength of the fifth harmonic of a signal, a gap between the third substrate connections 21 does not substantially affect the SN ratio of a transmitted signal.

In the substrate 2, signal conducting paths WB1 that are electrically connected to the signal electrodes 2*a* are sandwiched between ground conducting paths WB2 and WB3 that are formed on both the front and back surfaces of the substrate 2 and electrically connected to the ground electrode 2*b*, as illustrated in FIGS. 5B and 5C. In the signal transmission medium 3, the signal lines 3*a* are sandwiched between the ground transmission path 3*b* and the ground transmission path 3*c*. Use of the electrical connector 1A enables signal transmission lines formed of the signal lines 3*a*, the contacts 10, and the signal conducting paths WB1 to be sandwiched between a ground transmission line formed of the ground transmission path 3*b*, the upper shell 12*a*, and the ground conducting paths WB2 and WB3 and a ground transmission line formed of the ground transmission path 3*c*, the lower shell 12*b*, and the ground conducting paths WB2 and WB3. As a result, the leakage of noise to the outside and the contamination of noise from the outside can be prevented in the signal transmission lines formed of the substrate 2, the electrical connector 1A, and the signal transmission medium 3.

Embodiment 2

Figure 7:
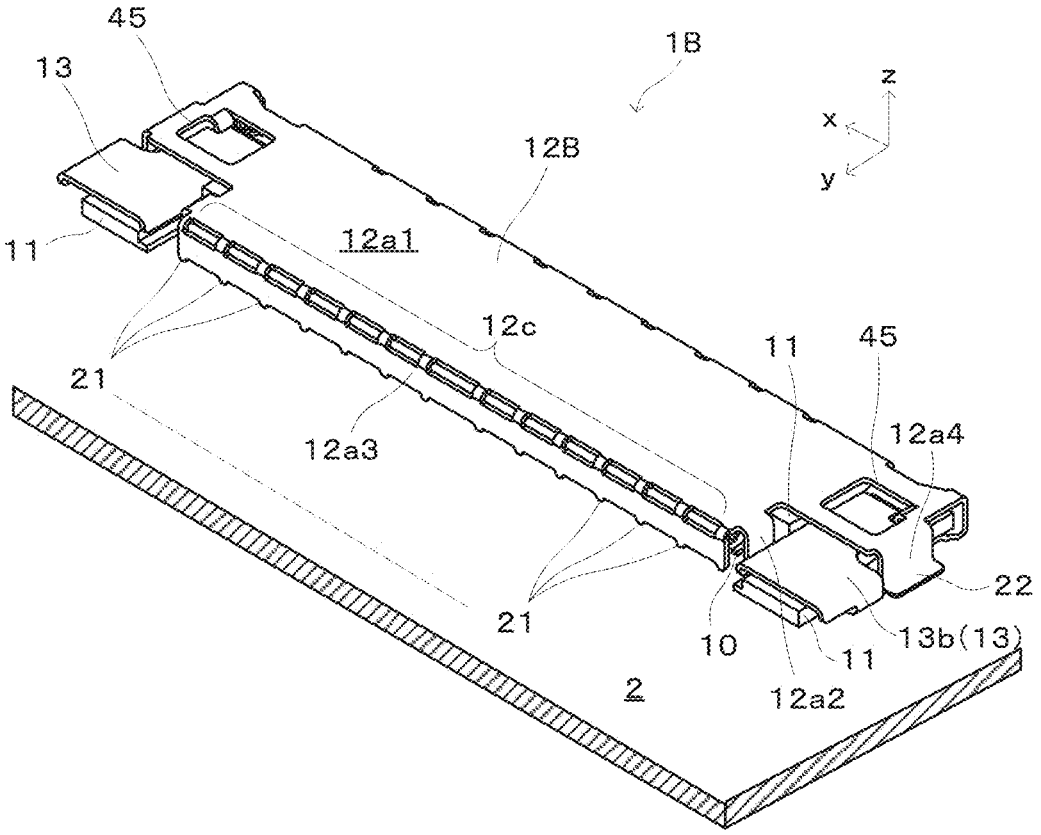
FIG. 7 is a perspective view illustrating the appearance of an electrical connector according to Embodiment 2 of the present disclosure.

Embodiment 2 of the present disclosure will now be described. As illustrated in FIG. 7, an electrical connector 1B according to the present embodiment differs from the electrical connector 1A in view of including a shell 12B instead of the shell 12A.

In the shell 12B, the back plate 12*a*3 of an upper shell 12*a* is coupled to an upper plate 12*a*1, and through-holes 12*c* are disposed in a coupling portion between the back plate 12*a*3 and the upper plate 12*a*1. The plural through-holes 12*c* are disposed at an equal spacing along the array direction (x-axis direction) of first substrate connections 10*a*.

The disposition of the through-holes 12*c* can facilitate bending of a part of the upper plate 12*a*1 to form the back plate 12*a*3.

The array spacing between the through-holes 12*c* is not more than the half-wavelength of the fifth harmonic of a signal transmitted through contacts 10. As a result, the leakage and contamination of noise having a wavelength that is not less than the wavelength of the fifth harmonic of the transmitted signal can be prevented.

According to each of the embodiments described above, a state can be achieved in which the first substrate connections 10*a* connected to the signal electrodes 2*a* of the substrate 2, in the contacts 10, are surrounded by the upper plate 12*a*1, the side plates 12*a*2, and the back plate 12*a*3 which are conductive and components included in the shell 12A or 12B connected to the ground electrode 2*b* of the substrate 2, as described in detail above. As a result, a current component caused by noise trapped by the upper plate 12*a*1, the side plates 12*a*2, and the back plate 12*a*3 can be allowed to immediately flow into the ground electrode 2*b*, and therefore, the leakage of noise from the first substrate connections 10*a* to the outside and the contamination of noise from the outside into the first substrate connections 10*a* can be more reliably prevented.

In each of the embodiments described above, the plural third substrate connections 21 are arrayed at an equal spacing along the array direction of the first substrate connections 10*a*. Even in such a manner, the leakage and contamination of noise can be reliably prevented if the spacing between the third substrate connections 21 is appropriate. However, the present disclosure is not limited thereto. The third substrate connections 21 may be disposed on the whole portion, facing the substrate 2, of the back plate 12*a*3.

In Embodiment 2 described above, the back plate 12*a*3 is coupled to the upper plate 12*a*1, the plural through-holes 12*c* are disposed at an equal spacing along the array direction of the first substrate connections 10*a* in the coupling portion between the back plate 12*a*3 and the upper plate 12*a*1. Even in such a manner, the leakage and contamination of noise can be reliably prevented.

In each of the embodiments described above, the shell 12A or 12B includes the upper shell 12*a* and the lower shell 12*b*. As a result, the whole outer peripheries of the contacts 10, which are parts of the signal transmission lines, can be covered to reliably prevent the leakage and contamination of noise. However, the lower shell 12*b* need not be included.

In each of the embodiments described above, the array spacing between the third substrate connections 21 is set at a value that is not more than the half-wavelength of the fifth harmonic of a transmitted signal. However, the present disclosure is not limited thereto. The array spacing between the third substrate connections 21 may be determined based on the frequency of the transmitted signal. For example, the array spacing may be set so as to prevent generation of a gap that is not less than 1/20 of the wavelength of the transmitted signal. The array spacing between the third substrate connections 21 may be set at a value that is not more than the wavelength of the signal or may be set at a value that is not more than the wavelength of the third harmonic of the signal. The same applies to the array spacing between the through-holes 12*c* of Embodiment 2.

In each of the embodiments described above, the upper shell 12*a*, the lower shell 12*b*, and the lock members 13 are formed of the same plate-like member. However, the present disclosure is not limited thereto. The lock members 13 may be formed of another member, or the upper shell 12*a* and the lower shell 12*b* may be formed of other members.

In each of the embodiments described above, the respective lock members 13 in the pair are arranged to overlap the side plates 12*a*2 and 12*a*4 on both ends in the array direction (x-axis direction) of the contacts 10. As a result, the lock members 13 are allowed to function as noise shielding members, whereby the leakage and contamination of noise can be more reliably prevented. However, the present disclosure is not limited thereto. The lock members 13 need not be used as the noise shielding members.

In order to confirm soldering in the first substrate connections 10*a*, the back plate 12*a*3 may be prevented from being bent from the upper plate 12*a*1 when the electrical connector 1A or 1B is mounted on the substrate 2. After the confirmation of the soldering in the first substrate connections 10*a*, the back plate 12*a*3 may be bent from the upper plate 12*a*1 to solder the third substrate connections 21 and the ground electrode 2*b* of the substrate 2 to each other.

In each of the embodiments described above, the electrical connector 1A or 1B in which the signal transmission medium 3 is a connection object is described. However, the present disclosure is not limited thereto. For example, the present disclosure may be adopted for two-piece-type electrical connectors formed of a plug connector and a receptacle connector. In such electrical connectors, one connector is mounted on a substrate, the other connector is connected to a signal transmission medium, and the connectors are engaged with each other, thereby electrically connecting both the connectors. Accordingly, the substrate connections of the connectors, connected to a substrate 2, are completely covered with the shells 12A and 12B of the connectors.

In each of the embodiments described above, the case has been described in which the present disclosure is applied to the electrical connector 1A or 1B for connection of a flexible printed circuit board (FFC) or a flexible flat cable (FFC). However, the present disclosure is not limited thereto. The present disclosure can also be applied to an electrical connector for connection between substrates or an electrical connector for connection between a coaxial cable and a substrate.

In each of the embodiments described above, the case has been described in which the present disclosure is applied to the horizontal-insertion-type electrical connector 1A or 1B. However, the present disclosure is not limited thereto. For example, the present disclosure can also be applied to a vertical-insertion-type electrical connector.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

The present disclosure can be applied to an electrical connector for connection between a substrate and a connection object.

1A, 1B Electrical connector
2 Substrate
2*a* Signal electrode
2*b* Ground electrode
3 Signal transmission medium
3*a* Signal line
3*b*, 3*c* Ground transmission path
3*d*, 3*e*, 3*f*, 3*g* Insulator
3*h* Positioner
10 Contact
10*a* First substrate connection
10*b* Contactor
10*c* Movable beam
11 Housing
11*a* Insertion opening
12A, 12B Shell
12*a* Upper shell
12*a*1 Upper plate
12*a*2 Side plate
12*a*3 Back plate
12*a*4 Side plate
12*b* Lower shell
12*c* Through-hole
13 Lock member
13*a* Locking pawl
13*b* Operator
20 Second substrate connection
21 Third substrate connection
22 Fourth substrate connection
23 Fifth substrate connection
30, 31 Shell spring
40, 41, 42 Coupler
45 Through-hole
WB1 Signal conducting path
WB2, WB3 Ground conducting path

What is claimed is:

1. An electrical connector comprising:

a plurality of conductive contacts that is arrayed in one direction in correspondence with a plurality of respective signal transmission members of a connection object, that comprises one ends on which contactors that come into contact with the signal transmission members are formed, and that comprises other ends on which first substrate connections that are connected to signal electrodes of a substrate are formed;

an insulating housing that retains the contacts; and a conductive shell that is connected to a ground electrode of the substrate and that comes into contact with a ground member of the connection object, wherein the shell comprises:

an upper plate that covers a whole of the plurality of contacts on the substrate;

side plates that block both ends of the first substrate connections in an array direction between the upper plate and the substrate and that comprise edges that face the substrate and on which second substrate connections connected to the ground electrode of the substrate are formed; and a back plate that blocks fronts of the first substrate connections with respect to the contactors between the upper plate and the substrate and that comprises an edge that faces the substrate and on which a third substrate connection connected to the ground electrode of the substrate is formed, wherein an insertion opening into which the connection object is inserted is disposed in the housing, and the shell comprises:

a first shell that comprises the upper plate, the side plates, and the back plate, that comes into contact with the ground member of the connection object in the insertion opening, and that is connected to the ground electrode of the substrate; and a second shell that is inserted between the substrate and a portion other than the first substrate connections in the plurality of contacts, that comes into contact with the ground member of the connection object in the insertion opening, and that is connected to the ground electrode of the substrate.

2. The electrical connector according to claim 1, wherein the plurality of third substrate connections is arrayed at an equal spacing along the array direction of the first substrate connections.

3. The electrical connector according to claim 1, wherein the back plate is coupled to the upper plate, and a plurality of through-holes is disposed at an equal spacing along the array direction of the first substrate connections in a coupling portion between the back plate and the upper plate.

4. The electrical connector according to claim 1, further comprising:

locking members in a pair that are disposed on both ends of the plurality of contacts in an array direction, respectively, and that are locked on the connection object inserted into the insertion opening, wherein the first shell, the second shell, and the locking member comprise an identical, plate-like member.

5. The electrical connector according to claim 4, wherein the respective locking members in the pair are arranged to overlap the side plates at both the ends of the contacts in the array direction.

* * * * *